United States Patent [19]

Carlson

[11] Patent Number: 4,472,705

[45] Date of Patent: Sep. 18, 1984

[54] THERMOSTATIC SWITCH WITH THERMAL OVERRIDE

[75] Inventor: Richard H. Carlson, Cumberland, R.I.

[73] Assignee: Elmwood Sensors, Inc., Pawtucket RI

[21] Appl. No.: 455,278

[22] Filed: Jan. 3, 1983

[51] Int. Cl.[3] ..... H01H 37/02

[52] U.S. Cl. ..... 337/299; 337/5; 337/35; 337/404

[58] Field of Search ..... 337/299, 363, 364, 1, 337/2, 3, 4, 5, 6, 12, 13, 35, 401, 402, 403, 404; 219/253, 251

[56] References Cited

U.S. PATENT DOCUMENTS 4,313,047 1/1982 Cox et al. ..... 337/402
4,319,126 3/1982 Lusic ..... 337/209
4,415,796 11/1983 Balchunas ..... 219/253

*Primary Examiner*—Harold Broome
*Attorney, Agent, or Firm*—Salter & Michaelson

[57] ABSTRACT

A bimetallic disc actuated thermostatic switch with thermal override comprises a base, a fixed contact on the base, a movable contact and a bimetallic disc which moves the movable contact into and out of engagement with the fixed contact to effect or interrupt continuity therebetween. A thermal override pellet which melts or deforms in response to an excessive temperature is provided in a cavity in the base and the fixed contact is mounted on a resilient arm which overlies the pellet. When an excessive temperature is reached, the pellet fuses or deforms and the fixed contact arm and the fixed contact move toward the base to separate the fixed and movable contacts even when the latter is in its normally engaged position.

7 Claims, 6 Drawing Figures

THERMOSTATIC SWITCH WITH THERMAL OVERRIDE

BACKGROUND AND SUMMARY OF THE INVENTION

The instant invention relates to bimetallic disc actuated thermostatic switches and more particularly to a bimetallic disc actuated thermostatic switch which includes a thermal override protection and which is adapted for miniaturization.

The possibility of undesirable thermal override of a bimetallic disc actuated thermostatic switch is often of prime concern in electronic circuit design. In this connection, it will be recognized that when a thermostatic switch is used to control the temperature in a particular area or environment, the failure of the switch to interrupt continuity in circuitry at the proper temperature level may result in significant malfunction of or damage to mechanical and/or electrical components due to overheating. While normally bimetallic disc actuated thermostatic switches are highly reliable, the extensive malfunction or damage which can result from the failure thereof makes the possibility of such malfunction a matter of grave concern. It will be recognized that the malfunction of a thermostatic switch can result from disc malfunction, drift, contact sticking, creep resulting from contact wear, physical damage to the switch from external sources or a number of other conditions. However, regardless of the cause, thermostatic switch malfunction must be considered in many bimetallic disc actuated thermostatic switch applications.

It is seen, therefore, that in many instances there is a need to provide some type of thermal override protection in circuitry controlled by bimetallic disc actuated thermostatic switches. In some cases this need has been fulfilled by providing thermal fuse protection which interrupts the circuitry when excessive temperature conditions are present. Examples of thermal fusing devices which are usable in applications of this type are disclosed in the U.S. Pat. No. 4,307,370, to Hollweck, and Sackamoto et al., U.S. Pat. No. 4,065,741. The concept of providing thermal override protection within a thermostatic switch is also generally known and is disclosed in the European patent application No. 80300246.8 to Eaton, which represents the closest prior art to the instant invention of which the applicant is aware. However, while the broad concept of providing thermal override protection in a thermostatic switch is generally known, a means of providing thermal override protection for miniature thermostatic switches has not been heretofore available. Specifically, the structural components heretofore available for providing thermal override protection in thermostatic switches have not been readily adaptable to miniaturization and hence their applicability has been limited in this area.

The instant invention provides a simple and effective thermal override protection for a bimetallic disc actuated thermostatic switch which permits effective miniaturization of the switch. In this regard the instant invention relates to a thermal override which can be used in a switch of the type disclosed in the applicant's copending U.S. patent application Ser. No. 347,842, which is soon to issue as U.S. Pat. No. 4,367,452. The thermostatic switch of the instant invention comprises a base portion having a fulcrum thereon, a housing mounted on the base portion, a fixed contact mounted adjacent the base portion, and a movable contact arm which overlies the fulcrum. A movable contact is provided on one end of the movable arm and the arm is pivotable on the fulcrum to cause the engagement or disengagement of the fixed and movable contacts to effect or interrupt continuity therebetween. A bimetallic disc of the switch is mounted in the housing in communication with the movable contact arm and flexes when the temperature in the surrounding environment rises to a predetermined level to cause the movable arm to be pivoted on the fulcrum and thereby interrupt electrical continuity between the fixed and movable contacts. The switch further comprises a thermal override pellet which is mounted in a cavity in the base portion and which is deformable from a first undeformed position thereof to a second deformed position of reduced profile relative to the base portion in response to a predetermined override or excessive temperature. The fixed contact of the switch is mounted in communication with the pellet and is biased thereagainst and accordingly when the pellet is deformed, the fixed contact automatically moves to a position wherein it is disengaged from the movable contact even though the latter is in its normally engaged position. As a result, while continuity between the fixed and movable contacts is normally effected or interrupted through the flexing of the bimetallic disc, if the switch malfunctions and the temperature in the surrounding environment reaches an excessive level the override pellet is deformed causing the fixed contact to be moved away from the movable contact to interrupt continuity and thereby provide a thermal override protection in the switch.

It is, therefore, a primary object of the instant invention to provide a thermal override protection for a bimetallic disc actuated thermostatic switch.

Another object of the instant invention is to provide a bimetallic disc actuated thermostatic switch with a thermal override protection which is suitable for miniaturization.

A still further object of the instant invention is to provide a bimetallic disc actuated thermostatic switch wherein a fixed contact of the switch is permanently moved to an inoperative position to interrupt electrical continuity in the switch in response to overheating conditions.

Other objects, features and advantages of the invention shall become apparent as the description thereof proceeds when considered in connection with the accompanying illustrative drawing.

DESCRIPTION OF THE DRAWINGS

In the drawings which illustrate the best mode presently contemplated for carrying out the present invention.

DESCRIPTION OF THE INVENTION

Figure 1:
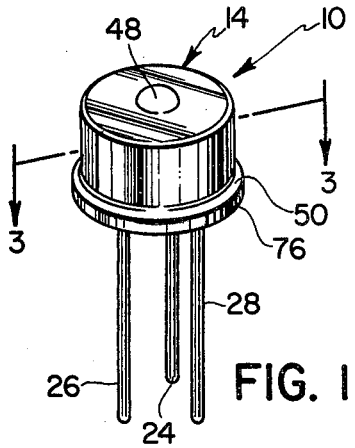
FIG. 1 is a perspective view of the thermostatic switch of the instant invention.
Figure 2:
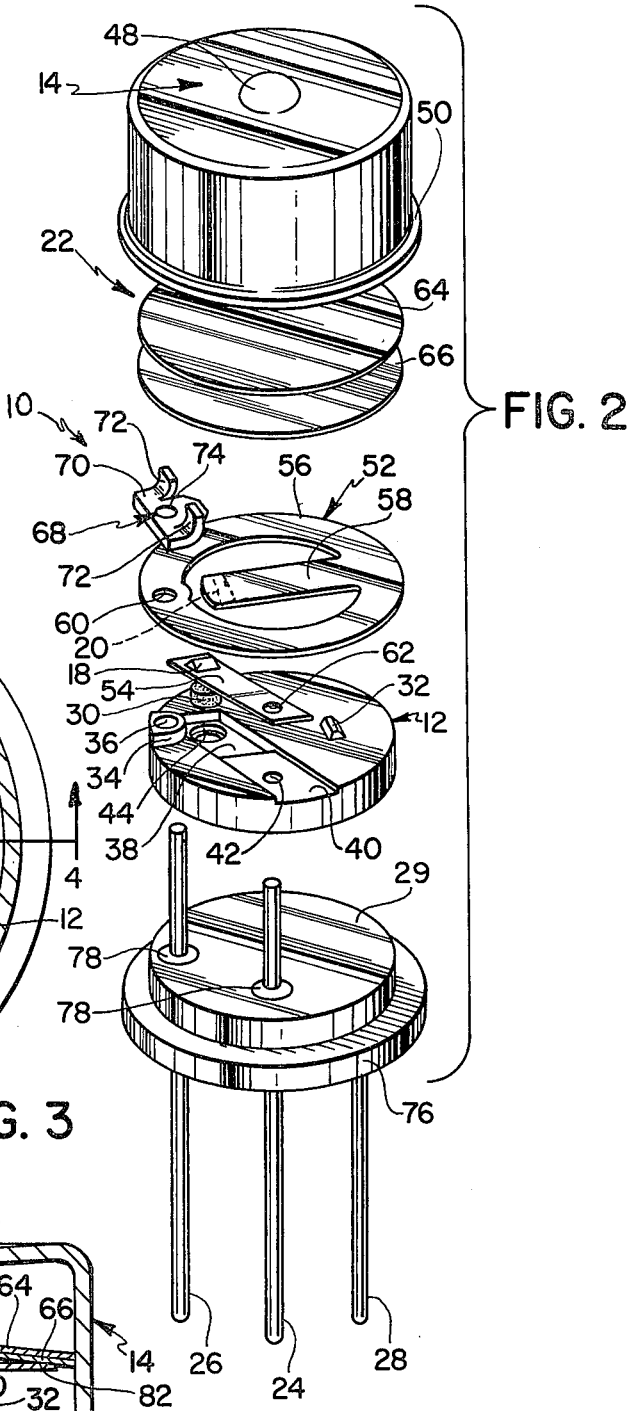
FIG. 2 is an enlarged exploded perspective view thereof.
Figure 3:
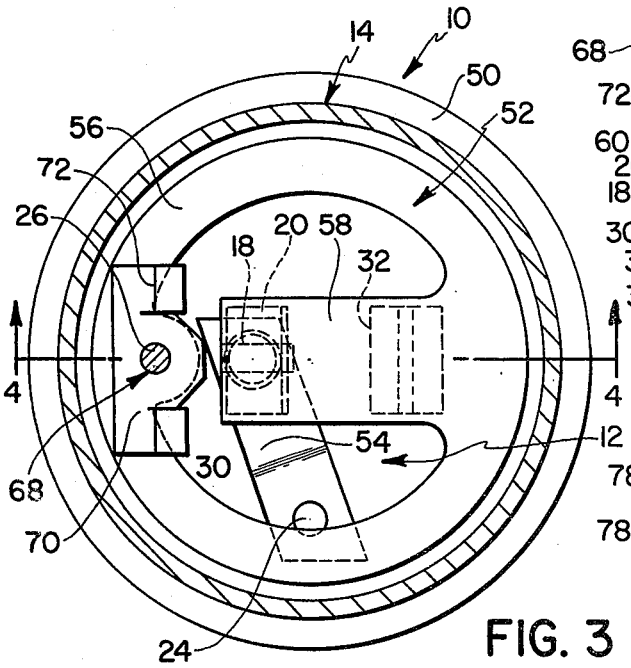
FIG. 3 is a further enlarged sectional view taken along line 3—3 in FIG. 1.

Referring now to the drawings, the thermostatic switch with thermal override of the instant invention is illustrated in FIGS. 1–6 and generally indicated at 10. The switch 10 comprises a base portion generally indicated at 12, a housing generally indicated at 14 mounted on the base portion 12, a switching assembly generally indicated at 16 which is disposed within the housing 14 and includes fixed and movable contacts 18 and 20, respectively, and a bimetallic disc assembly generally indicated at 22 which is also disposed within the housing 14. The switch 10 further comprises first and second external electrical terminal elements 24 and 26, respectively, which are electrically connected to the fixed and movable contacts 18 and 20, respectively, a third electrical terminal element 28 which is electrically connected to the housing 14 and a header 29 which is disposed beneath the base portion 12 and through which the terminal elements 24 and 26 extend. The bimetallic disc assembly 22 operates to interrupt electrical continuity between the fixed and movable contacts 18 and 20, when the temperature in the surrounding area rises above a predetermined actuating temperature level and to effect continuity therebetween when the temperature falls below said level. The switch 10 further comprises a thermal override pellet 30 which is mounted on the base portion 12 and which is deformable to a disposition of reduced profile in response to exposure to a predetermined excessive or thermal override temperature which is higher than the above mentioned actuating temperature. The fixed contact 18 is mounted in communication with the pellet 30 so that when the pellet 30 is deformed, the fixed contact 18 follows the movement thereof to interrupt continuity between the fixed and movable contacts 18 and 20 regardless of the dispositions of the switching assembly 16 and/or the disc assembly 22. Accordingly, the pellet 30 provides a thermal override protection in the switch 10 which interrupts electrical continuity between the first and second external terminal elements 24 and 26, respectively, in the event of excessive heat conditions.

The base 12 comprises a circular disc made of an electrical insulating material such as a ceramic and has a fulcrum 32 formed therein as well as a raised boss 34, the boss 34 having an aperture 36 therethrough which also extends through the base 12. Formed in the upper surface of the base 12 are a recess 38 and a reduced or shallow recess 40 which is adjacent the recess 38 and which has an aperture 42 therethrough. A circular cavity 44 having a recessed circular groove 46 at the lower end thereof is provided in the recess 38.

Figure 4:
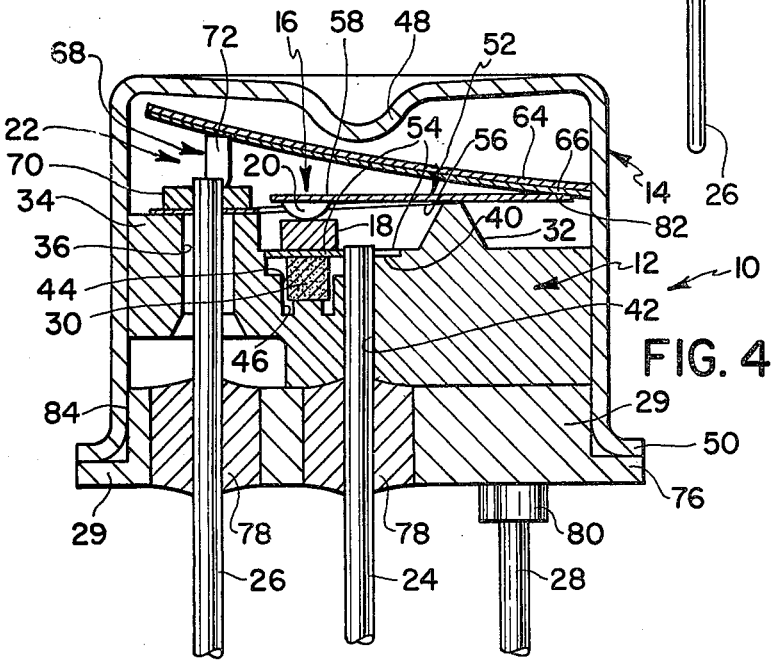
FIG. 4 is a sectional view taken along line 4—4 in FIG. 3 with the fixed and movable contacts of the switch in engagement.
Figure 5:
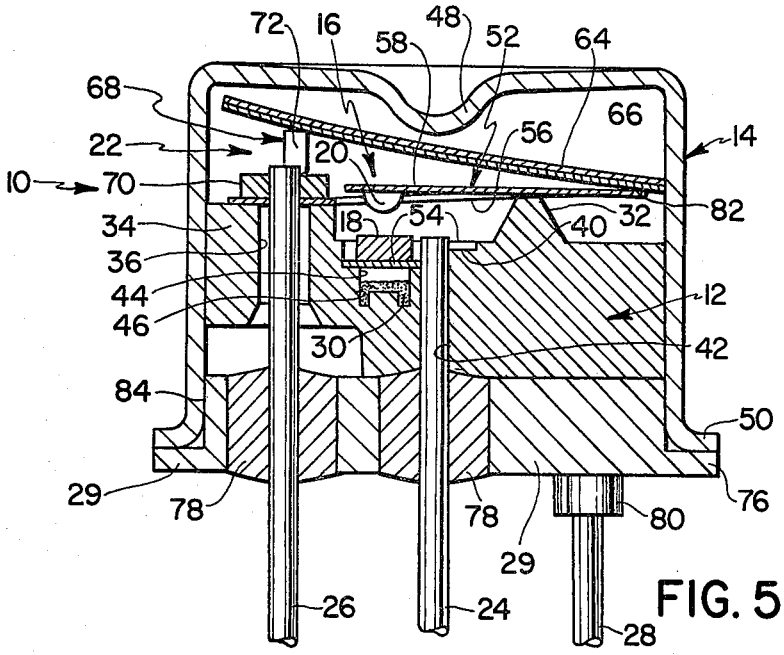
FIG. 5 is a similar view with the thermal override pellet of the switch in a deformed disposition to interrupt continuity between the fixed and movable contacts.
Figure 6:
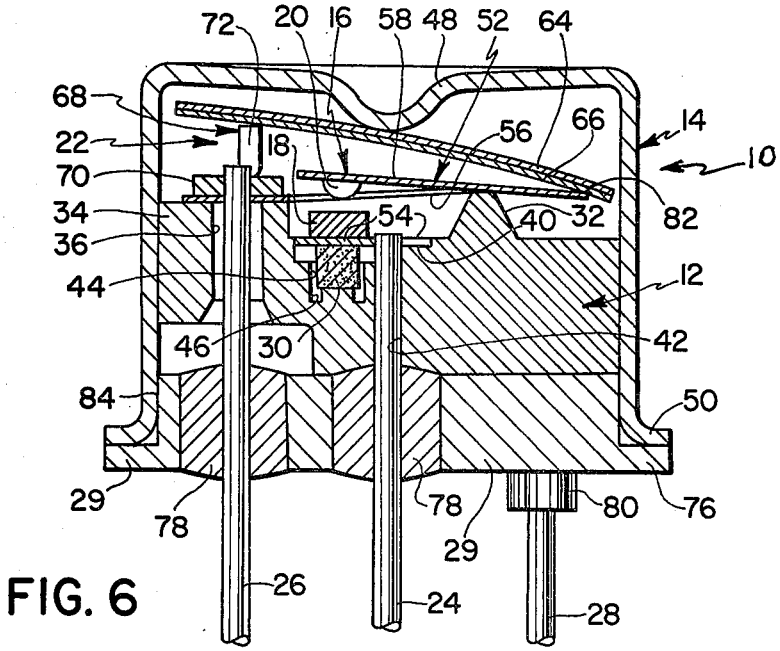
FIG. 6 is a similar view with the pellet in an undeformed disposition but with the bimetallic disc flexed upwardly to interrupt continuity between the fixed and movable contacts.

The housing 14 comprises a metallic can having an indentation or abutment 48 in the upper surface thereof and an outwardly extending annular flange 50 at the lower or open end thereof. The housing 14 is dimensioned to snugly receive the base portion 12 and the header 29 as illustrated in FIGS. 4–6.

The switching assembly 16 comprises the fixed and movable contacts 18 and 20, an actuator disc 52 on which the movable contact 20 is mounted, and a resilient fixed contact arm 54 on which the fixed contact 18 is mounted. The actuator disc 52 is made of a resiliently deformable electrically conductive metal and comprises a peripheral ring portion 56 and a movable contact arm 58 which extends substantially radially inwardly from the ring portion 56. The movable contact 20 is mounted on the arm 58 adjacent the free end thereof and an aperture 60 extends through the ring portion 56 adjacent the free end of the arm 58. The fixed contact arm 54 is made of a resilient electrically conductive metal in a generally quadrilateral configuration and has an aperture 62 therethrough adjacent one end thereof and has the fixed contact 18 secured thereto adjacent the opposite end thereof.

The pellet 30 can be made of any suitable substance having a melting temperature which corresponds to the particular temperature (herein referred to as the excessive or thermal override temperature) at which the thermal override feature of the instant invention takes effect. In this regard the pellet 30 may be made of an organic substance such as anhydrous pthalic acid, salicyclic acid, levulose, and/or glucose depending on the desired thermal override temperature. The pellet 30 can also be made of a suitable metal or metal alloy. In this connection tin, bismuthn, cadmium lead or zinc can be effectively used. The pellet 30 is preferably formed in a cylindrical configuration and is dimensioned to be received in the cavity 44.

The bimetallic disc assembly 22 comprises a circular bimetallic disc 64, a circular insulator disc 66 of substantially the same dimension as the bimetallic disc 64 and a pivot support 68. The support 68 comprises a substantially flat base portion 70 and a pair of upwardly extending spaced support fingers 72. An aperture 74 is provided in the base portion 70.

The header 29 is preferably made of a suitable electrically conductive metal such as steel and has a lower annular flange 76. The terminal elements 24 and 26 extend through the header 29 and are electrically insulated therefrom with glass sleeves 78 which are bonded to the respective terminal elements and to the header 29 by conventional glass-to-metal bonding techniques. The third terminal element 28 is electrically connected to the header 29 and has a metallic collar or weld abutment 80 thereon adjacent the header 29.

The assembled configuration of the switch 10 is illustrated most clearly in FIGS. 4–6. In this regard, the base 12 is received on the header 29 so that the terminal elements 24 and 26 extend through the apertures 42 and 36, respectively. The pellet 30 is received in the cavity 44 and the fixed contact arm 54 overlies the pellet 30 and is disposed within the recesses 38 and 40 with the fixed contact 18 facing upwardly. The uppermost end of the first terminal element 24 extends through the aperture 62 and the fixed arm 54 and is secured thereto by suitable means such as resistance welding or soldering to effect electrical continuity therebetween and to secure the fixed arm 54 on the base 12. The arm 54 is resiliently biased toward the pellet 30 so that when the pellet 30 is melted or deformed to a disposition of reduced profile, the free end of the arm 54 to which the fixed contact 18 is secured moves downwardly into the recess 38 as will hereinafter be more fully set forth. The actuator disc 52 is disposed on the base 12 so that the arm 58 overlies the fulcrum 32 at a point adjacent the connected end of the arm 58. The second terminal element 26 extends through the aperture 60 and the support 68 is received on the uppermost end of the terminal element 26 with the element 26 received in the aperture 74. The support element 68 is secured and electrically connected to the terminal element 26 and actuator disc 52 by suitable means such as resistance welding or soldering whereby the support 68 secures the disc 52 in captured relation on the base 12. When the fixed contact arm 54 and the actuator disc 52 are secured on the base 12 in this manner, the fixed and movable contacts 18 and 20, respectively, are in aligned facing relation so that they are engageable to effect electrical continuity between the first and second terminal elements 24 and 26. The bimetallic and insulator discs 64 and 66, respectively, are disposed in substantially aligned relation with the insulator disc 66 engaging the upper ends of the support fingers 72 and engaging the actuator disc 52 as at 82 adjacent the connected end of the arm 58. The bimetallic disc 64 overlies the insulator disc 66 so that it is electrically insulated from the actuator disc 52 and the fingers 72. However, because the insulator disc 66 and the bimetallic disc 64 are supported at three points (by the two fingers 72 and by the actuator disc 52 adjacent the connected end of the arm 58 as at 82) the discs 64 and 66 are maintained in stable relation in the switch 10 without wobbling. The housing or can 14 is received on the base 12 and the header 29 as illustrated in FIGS. 4–6 so that the abutment 48 projects towards the central portion of the bimetallic disc 64 and so that the flange 50 abuts the flange 76. Preferably the housing 14 is secured to the header 29 by resistance welding as at 84 to effect a positive electrical connection therebetween and to hermetically seal the lower end of the switch 10.

In use and operation of the switch 10, the first and second terminal elements 24 and 26 are connected to the appropriate circuit components and the third terminal element 28 is preferably connected to ground. When the temperature in the environment of the switch 10 is below the temperature level required to cause the central portion of the bimetallic disc 64 to flex upwardly, i.e. below the actuating temperature, the switch 10 assumes the disposition illustrated in FIG. 4 wherein the central portion of the disc 64 is flexed downwardly, the actuator disc 52 is substantially planar and the movable contact arm 58 is in a first position thereof wherein the fixed and movable contacts 18 and 20, respectively, are in engagement to effect electrical continuity therebetween and between the first and second terminal elements 24 and 26, respectively. However, when the temperature in the environment of the switch 10 is increased to a level sufficient to cause upward flexing of the central portion of disc 64, i.e. it is raised above its actuating temperature, the switch 10 is normally moved to the disposition illustrated in FIG. 6 wherein the disc 64 is flexed upwardly so that it engages the abutment 48 causing downward pressure to be exerted on the actuator disc 52 as at 82 adjacent the connected end of the movable contact arm 58. This causes the actuator disc 52 to be resiliently deformed whereby the arm 58 is pivoted on the fulcrum 32 to move the arm 58 to a second position thereof wherein the movable contact 20 is separated from the fixed contact 18 as shown in FIG. 6. Accordingly, when the temperature in the environment of the switch 10 is elevated to the point where the central portion of disc 64 flexes upwardly, electrical continuity is normally interrupted between the first and second terminal elements 24 and 26, respectively.

In the event of the malfunction of the switching assembly 16 and/or of the bimetallic disc assembly 22, however, continuity between the first and second terminal elements 24 and 26 will not be interrupted at the actuating temperature and hence the temperature in the environment of the switch 10 may continue to rise to excessive levels. For this reason the switch 10 includes the override pellet 30 to effect an interruption of the continuity between the terminal elements 24 and 26 when excessive temperature conditions are present. Under normal conditions, the pellet 30 remains in its normal undeformed cylindrical disposition as illustrated in FIGS. 4 and 6. However, when the temperature in the environment of the switch 10 rises to a level which is considered to be excessive, i.e. to the excessive or override temperature, the pellet 30 is melted or deformed to a disposition of reduced profile as illustrated in FIG. 5 wherein the pellet 30 has moved downwardly in the cavity 44 and into the groove 46. When the pellet 30 is deformed in this manner the fixed contact arm 54, which is resiliently biased towards the pellet 30, is moved from its normal first position downwardly so that the free end of the arm 54 is moved into the recess 38 to effect an override interruption between the fixed and movable contacts 18 and 20, respectively, by moving the fixed contact 18 downwardly. Accordingly, electrical continuity between the first and second terminal elements 24 and 26 is interrupted regardless of the dispositions of the switching assembly 16 and/or the bimetallic disc assembly 22 whereby a positive thermal override protection is provided in the switch 10.

It is seen, therefore, that the instant invention provides an effective thermostatic switch with thermal override protection. When the temperature in the environment of the switch 10 reaches a level sufficient to melt or deform the pellet 30, continuity between the terminal elements 24 and 26 is effectively interrupted. This minimizes the risk of mechanical and/or electrical equipment damage as a result of excessive temperature conditions. Further, the unique construction of the switch 10 makes it particularly adaptable for miniaturization. In particular, by providing direct movement of the fixed contact 18 to simply and easily interrupt continuity in the switch 10 with a minimum of components, the switch 10 is readily adapted for miniaturization. Accordingly, it is seen that for these reasons as well as the other reasons hereinabove set forth, the instant invention represents a significant advancement in the thermostatic switch art which has substantial commercial merit.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermostatic switch with thermal override comprising a base portion, a housing on said base portion, a thermal override pellet on said base portion deformable from a first position to a second position of reduced profile in response to a predetermined excessive temperature, a fixed contact, means mounting said fixed contact on said pellet so that when said pellet is deformed to said second position thereof, said fixed contact follows the deformation of said pellet and is thereby moved toward said base from a first position of said fixed contact to a second position thereof, an electrically conductive movable contact arm having a movable contact on a first end of said arm, means mounting said arm so that said arm is pivotable between a first position wherein said fixed and movable contacts are in engagement to effect electrical continuity when said fixed contact is in said first position thereof but spaced to interrupt said continuity when said fixed contact is in said second position thereof and a second position of said arm wherein said movable contact is spaced from said fixed contact regardless of whether said fixed contact is in said first or second positions thereof, and bimetallic means mounted within said housing communicating with said arm to move said arm between said first and second positions thereof in response to a rise in temperature to a predetermined level which is lower than said excessive temperature.

2. A thermostatic switch with thermal override comprising a base portion, a housing on said base portion, a fulcrum on said base portion, a thermal override pellet on said base portion deformable from a first position to a second position of reduced profile in response to a predetermined excessive temperature, a fixed contact, means mounting said fixed contact on said pellet so that when said pellet is deformed to said second position thereof, said fixed contact follows the deformation of said pellet and is thereby moved toward said base from a first position of said fixed contact to a second position thereof, an electrically conductive movable contact arm overlying said fulcrum, a movable contact on a first end of said arm, means mounting said arm in overlying relation on said fulcrum so that said arm is pivotable thereon between a first position wherein said fixed and movable contacts are in engagement to effect electrical continuity when said fixed contact is in said first position thereof but spaced to interrupt said continuity when said fixed contact is in said second position thereof and a second position of said arm wherein said movable contact is spaced from said fixed contact regardless of whether said fixed contact is in said first or second positions thereof, and bimetallic means mounted within said housing communicating with a second end of said arm which is opposite said first end to move said arm between said first and second positions thereof in response to a rise in temperature to a predetermined level which is lower than said excessive temperature.

3. In the switch of claim 1, said fixed contact mounting means comprising a fixed contact arm mounted on said base portion, said arm having a free end which overlies said pellet and is biased thereagainst, said fixed contact being mounted on said fixed contact arm adjacent the free end thereof.

4. In the switch of claim 3, said base portion having a cavity therein, said pellet being mounted in said cavity and extending upwardly therefrom when said pellet is in said first position thereof but being disposed entirely within said cavity when said pellet is in said second position thereof, the free end of said fixed contact arm moving toward said cavity when said pellet is deformed to said second position thereof.

5. In the switch of claim 2, said movable contact arm being integrally formed as a resilient deformable electrically conductive actuator disc having a substantially circular peripheral ring which comprises a contact arm mounting means, said movable contact arm being attached adjacent the second end thereof to said ring and extending substantially radially inwardly therefrom, said ring being secured to said base portion at a point which is distal the connected second end of said movable contact arm.

6. In the switch of claim 5, said arm overlying said fulcrum at a point adjacent the connected end of said arm.

7. In the switch of claim 6, said bimetallic disc communicating with the peripheral portion of said actuator disc ring adjacent the connected end of said actuator arm to move said actuator arm between said first and second positions thereof.

* * * * *